United States Patent [19]

Kuchenbecker

[11] 4,436,206

[45] Mar. 13, 1984

[54] RECLOSABLE PAPERBOARD CARTON STRUCTURE

[75] Inventor: Morris W. Kuchenbecker, Neenah, Wis.

[73] Assignee: James River/Dixie-Northern, Inc., Norwalk, Conn.

[21] Appl. No.: 302,388

[22] Filed: Sep. 15, 1981

[51] Int. Cl.[3] ..... B65D 5/54

[52] U.S. Cl. ..... 206/625; 206/608; 206/621; 206/633; 229/37 R

[58] Field of Search ..... 206/601, 605, 608, 609, 206/611, 613, 615, 621, 622, 624, 625, 626, 628, 630, 633, 634, 620; 229/38, 37, 39 R, 39 B, 44 R

[56] References Cited

U.S. PATENT DOCUMENTS

| | | | |
|---|---|---|---|
| 2,828,060 | 3/1958 | Brown . | |
| 3,018,941 | 1/1962 | Wagaman . | |
| 3,228,573 | 1/1966 | Nerenberg et al. | 206/633 |
| 3,257,067 | 6/1966 | Buttery et al. | 206/608 |
| 3,281,059 | 10/1966 | Buttery et al. . | |
| 3,298,595 | 1/1967 | Collura | 206/608 |
| 3,491,937 | 1/1970 | Brastad . | |
| 3,554,432 | 1/1971 | Horry | 229/38 |
| 3,595,466 | 7/1971 | Rosenburg, Jr. | 206/633 |
| 3,918,631 | 11/1975 | Hackenberg | 229/37 R |
| 4,083,454 | 4/1978 | O'Neill | 206/605 |
| 4,236,636 | 12/1980 | Kuchenbecker . | |

*Primary Examiner*—George E. Lowrance
*Assistant Examiner*—Jimmy G. Foster
*Attorney, Agent, or Firm*—Finnegan, Henderson, Farabow, Garrett & Dunner

[57] ABSTRACT

Reclosable carbon structure of a generally rectangular configuration is set up from a paperboard blank. A top wall serving as a closure is hinged along one edge portion to the carton and the opposite edge portion of the top wall includes a downturned flap extending over a side wall of the carton. The flap is adhered to the side wall in areas surrounded by discontinuous knife cuts provided on at least the flap or the panel so that, upon opening the closure, the knife cut area is delaminated in a controlled pattern.

18 Claims, 9 Drawing Figures

RECLOSABLE PAPERBOARD CARTON STRUCTURE

BACKGROUND OF THE INVENTION

This invention relates to packaging, and more particularly to improvements in carton structure of the tamperproof, reclosable type formed from a single paperboard blank.

In the sealing of reclosable paperboard cartons of the so-called flip-top type, it has been a practice to form extended lines of weakness that permit tearing adhesively retained flap portions of closure panels from an underlying carton wall, facilitating opening of the carton and subsequent reclosure thereof. Such adhesively retained closure flaps in tearing away, however, delaminate the underlying wall in a random pattern, often to the extent of weakening or defacing the carton.

Surface cut scoring disposed about and defining predetermined areas has been resorted to instead of lines of weakness, and ahhesive then applied to the areas which upon opening are delaminated within the confines of the areas defined by the lines of weakness. Surface cut scoring requires care in insuring that the die does not cut through the paperboard and punch out the area to which adhesive is to be applied, since the surface cuts generally are close to, and are made concurrently with knife cuts in the die cutting of a blank.

It is a general objective of the present invention to provide for a carton structure an improved adhesively retained closure means that facilitates opening and reclosure of the carton.

It is a further and more specific objective of the invention to provide improved sealing closure means for a carton facilitating access to its contents as well as locking reclosure thereof.

SUMMARY OF THE INVENTION

In achievement of the foregoing as well as other objectives, the invention contemplates reclosable paperboard carton structure comprising: an open-top body portion including upstanding front and rear walls and opposed end walls; a cover including a top wall hinged along an edge portion thereof to said rear wall, and a depending front flap on the free edge portion of said top wall opposite the recited hinged edge portion; and means releasably adhering said flap to said front wall comprising adhesive disposed in predetermined areas defined by discontinuous knife cuts, in at least one of said flap and said front wall, the construction and arrangement being such that the flap may be pulled away from the front wall by delaminating said wall in the areas defined by said knife cuts, reclosure of the carton being afforded by inserting the flap behind the front wall.

The manner in which the foregoing as well as other objectives and advantages may best be achieved will be more fully understood from a consideration of the following description, taken in light of the accompanying drawing.

DETAILED DESCRIPTION OF THE PREFERRED EMBODIMENT

Figure 1:
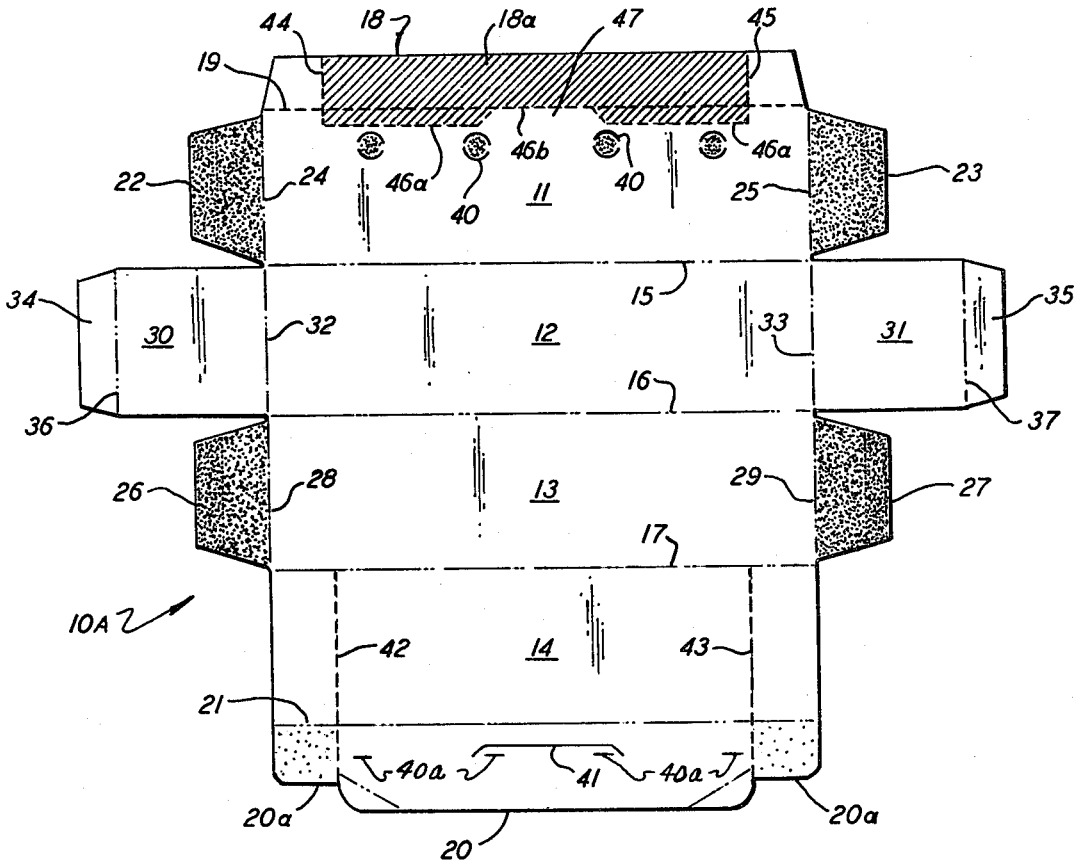
FIG. 1 is a top plan view of a cut and scored paperboard blank from which the carton embodying the invention is set up.

With more detailed reference to the drawings, there is seen in FIG. 1 a suitably cut and scored paperboard blank 10A including front, bottom, rear, and top walls 11, 12, 13, and 14, respectively. Adjacent ones of the hereinabove mentioned walls are hingedly connected by respective parallel score lines 15, 16, and 17. A reinforcing flap 18, hereinbelow to be more fully described, is hingedly connected to a free edge of front wall panel 11 by a perforated score line 19. A combination glue and relocking flap 20 is hingedly connected to the central region of the free edge of top wall panel 14 by a score line 21. Glue flaps 22 and 23 are hingedly connected by respective score lines 24 and 25 to front wall panel 11, and glue flaps 26 and 27 are hingedly connected to rear wall panel 13 by respective score lines 28 and 29.

Still with reference to FIG. 1, end flaps 30 and 31 are hingedly connected to bottom wall panel 12 by respective score lines 32 and 33, and flaps 30 and 31 have tabs 34 and 35 respectively hingedly connected to free edges thereof by respective score lines 36 and 37. The stippling on glue flaps 22, 23, 26, and 27, and on portions 20*a* of flap 20 represent glue or adhesive used in assembling the carton.

A cut 41 is provided in flap 20, parallel to and between score line 21 and the free edge of the flap. A pair of parallel lines of weakness 42, 43, each spaced inwardly from an end of top wall panel 14, extends across the top wall panel and the boundary between one of portions 20*a* and flap 20. A pair of lines of weakness 44, 45 extend transversely across flap 18 and onto front wall panel 11 to define a central tear-out portion 18*a*, and are aligned with lines of weakness 42, 43, respectively. A line of weakness 46 in front wall panel 11 extends between lines of weakness 44, 45, and includes portions 46*a* parallel to perforated score line 19 and a central section 46*b* coincident with perforated score line 19.

In especial accordance with the invention, and as will be more fully appreciated from the set-up mode of the carton, a series of equally spaced, generally circular knife cuts 40 are disposed along a line spaced from the lines of weakness 46*a*, and to the regions enclosed by knife cuts 40 there will be applied glue or adhesive as indicated by stippling. The less densely shaped stippling on flap portions 20*a* of FIG. 1 indicates glue application on the side of carton blank 10A facing away from the viewer. Knife cuts 40 preferably comprise substantially semi-circular segments disposed one above the other so as to present a raw edge of paperboard at the bottom and at the top of the circle. By such disposition, the bottom of the circle is defined by the lower semi-circular segment closest to the free edge of flap 20, when flap 20 is in the closed position. While a generally circular configuration for a knife cut 40 is preferred, it will be understood that the cuts may be for example, rectangular or triangular so long as the segments thereof are above and below one another as are the semi-circular segments, and have general symmetry about a horizontal axis parallel to the free edge of the top wall 14, or about a vertical axis at right angles to the free edge of the top wall 14. Knife cuts **40*a* are provided in flap 20 at intervals corresponding with the intervals of knife cuts 40, and along a line spaced from score line 21 the same distance as upper segments of knife cuts 40 are spaced from perforated score 19**.

Figure 2:
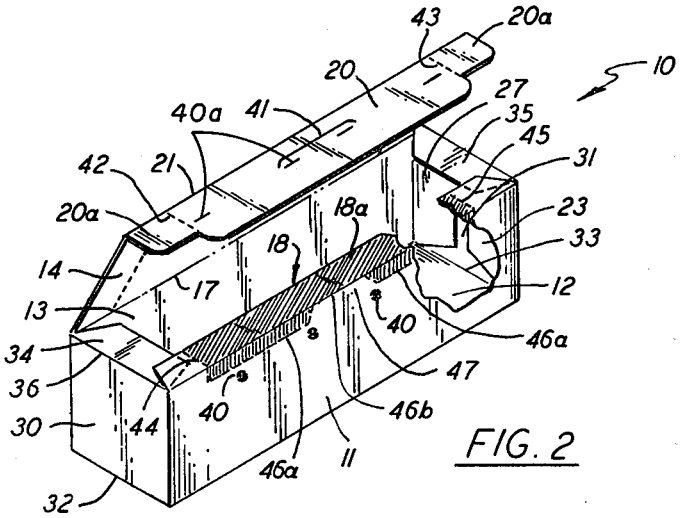
FIG. 2 is a fragmented perspective view of a carton that has been partially assembled from the blank shown in FIG. 1.
Figure 4:
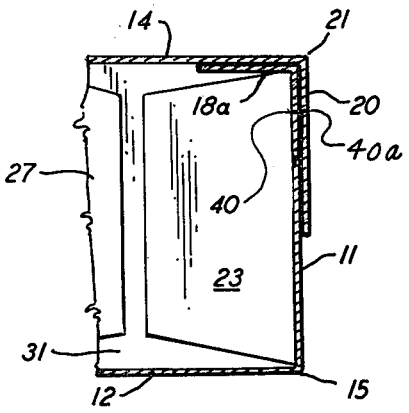
FIG. 4 is a section taken along the line 4—4 in FIG. 3.
Figure 3:
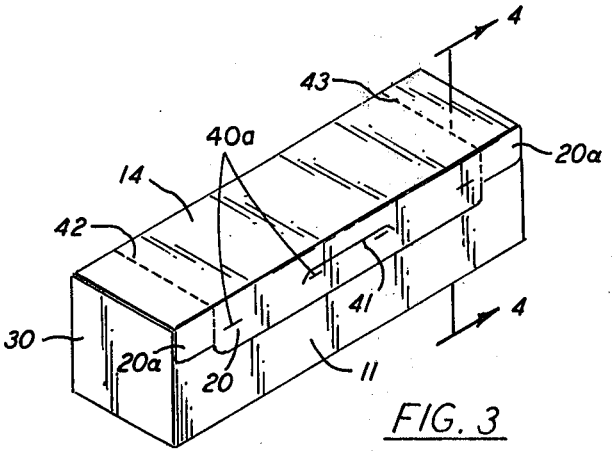
FIG. 3 is a perspective view of the carton seen in FIG. 2 in a closed, sealed mode.

With reference to FIG. 2, there is seen a set-up carton 10, wherein the several wall panels will be referred to as walls. In the set-up mode of the carton, and, for the sake of convenience, using vertical front wall 11 as a reference, bottom and rear walls 12 and 13 have been folded successively to the positions shown, followed by folding glue flaps 22, 26 and 23, 27 inwardly, and folding end flaps 30 and 31 thereover and adhering them to the glue flaps. At this stage of set-up the carton will have been ready for filling, following which end tabs 34 and 35 will be folded over the open top followed by folding reinforcing flap 18 inwardly partially over the carton opening as a flange extending beneath cover 14, at a right angle to front wall 11, and presented toward the hinged edge of the cover. Top wall 14 is then folded over, as is seen in FIG. 3, and flap 20 is adhered to front wall 11 at glue areas on flap portions **20*a* and in regions enclosed by circular knife cuts 40 as seen in FIG. 4. Also as is seen in FIG. 4, in the closed, adhered position of flap 20, each knife cut 40*a* is in registry with an upper portion of a knife cut 40**.

It will be appreciated that in adhering flap 20 to front wall 11 sufficient pressure is required against the flap to ensure that the glue is fully adherent to the wall. Any tendency of wall 11 to bow under this pressure, and result in a defective adhesive seal, is resisted by the rigidifying effect of reinforcing flap 18 in folded positions thereof seen in FIGS. 2 and 4. The structure of the flap 18, and its cooperative disposition as respects the remainder of the carton also is disclosed, and is claimed in my copending application Ser. No. 302,387 filed Sept. 15, 1981, and assigned to the assignee of the present invention.

Figure 6:
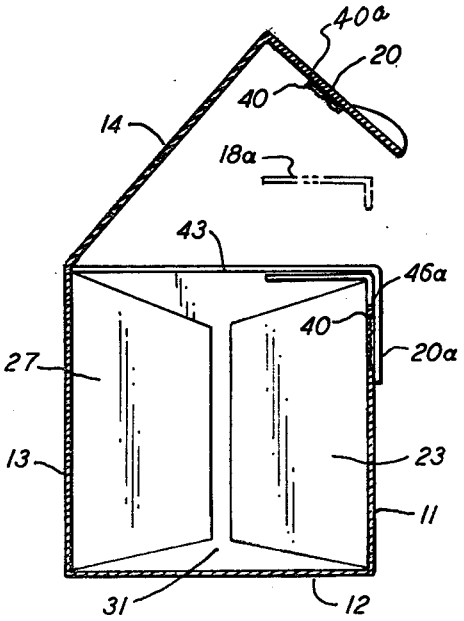
FIG. 6 is a section taken along the line 6—6 in FIG. 5.
Figure 5:
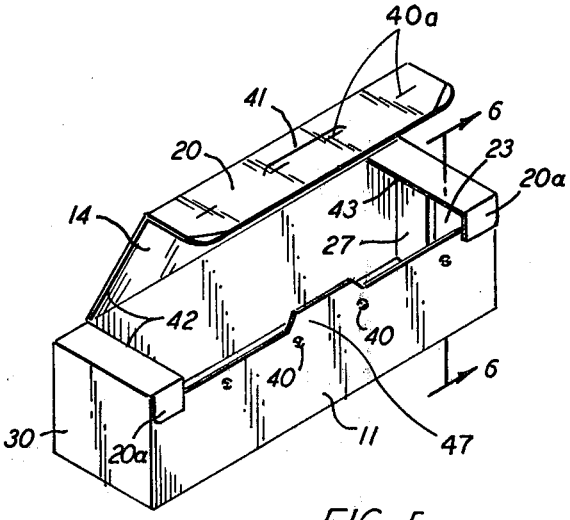
FIG. 5 is a perspective view of the carton seen in FIG. 3 in an unsealed, opened mode and with a part removed.
Figure 7:
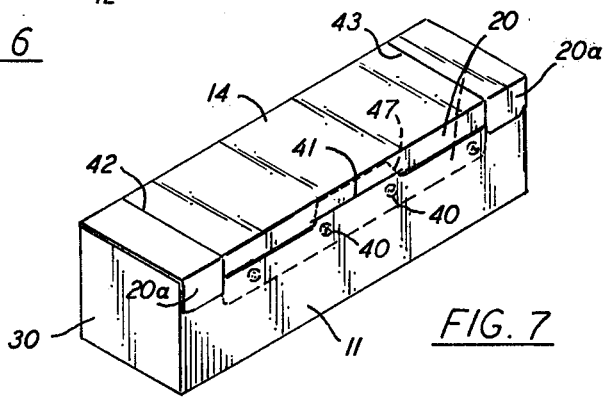
FIG. 7 is a view of the carton seen in FIG. 5, in a reclosed, locked mode.

In further accordance with the invention and with reference to FIGS. 5 and 6, to open the carton, flap 20 is pulled away from front wall 11, whereupon the regions of the wall enclosed by knife cuts 40 undergo ply separation or peeling, generally in controlled manner from bottom to top. Although release by ply separation is positive within the regions on the wall 11 enclosed by knife cuts 40, there has been found on occasion a tendency for the flap 20 to undergo some peeling or ply separation. The knife cuts **40*a* in registry with upper portions of knife cuts 40 advantageously operate to terminate any such ply separation. Also at this time, flap 20 and top wall 14 are torn along lines of weakness 42, 43 upon continued pivotation of the flap and wall to the illustrated open position. Access to contents of the carton is then achieved by tearing out the central portion 18*a* of flange 18, and portions of the front wall 11 along lines of weakness 44, 45 and 46, and discarding same. Removal of portion 18*a* also results in formation of a tab 47 defined by the offset of portions 46*a*, 46*b* of line of weakness 46. To reclose and lock the carton, top wall 14 is pivoted to closed position, accompanied by inserting flap 20 behind wall 11 while inserting tab 47 into cut 41, as shown in FIG. 7**.

Figure 8:
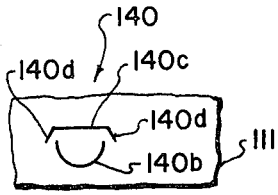
FIGS. 8 and 9 are modified embodiments of the invention.

With reference to FIG. 8, there is seen a modified embodiment wherein the knife cuts have an alternative configuration, such as is hereinabove briefly described. In the illustrated modified embodiment each knife cut 140 includes lower, generally semi-circular segment **140*b*, and upper straight segment 140*c* spaced slightly above and parallel to the diameter of semi-circular segment 140*b*. Further to knife cut segments 140*c*, each includes a pair of downwardly sloping segments 140*d* extending from the ends of the horizontal segment 140*c*, each at about a 45° angle thereto, to a point below the diameter of semicircular knife cut segment 140*b*. Thus it is seen that the knife cuts 140 are generally symmetrical about a line extending at right angles to the free edge portion of top wall 14 or perforated score line 19 in the assembled or set-up mode of the carton. Also in the present modified embodiment, the parallel segment 140*c* of the upper portion of knife cut 140 is disposed for registry with a knife cut 40*a*. As is the case in the hereinabove described other embodiment, the upper portion of knife cuts 140 comprising segments 140*c* and 140*d* limit the tearing out or delamination of the paperboard to the region enclosed by knife cuts 140**.

Figure 9:
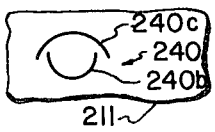

With reference to FIG. 9, a further modified embodiment comprises knife cuts 240 each including lower, generally semi-circular or arcuate segment **240*b*, and upper, generally semi-circular or arcuate segment 240*c*. The concave sides of the arcuate segments are mutually facing, and the lower segment 240*b* is shorter than the upper segment 240*c*. Also, the shorter segment 240*b* terminates within the region enclosed by the longer segment 240*c*** and a line connecting its ends.

It is seen, therefore, that in each of FIGS. 8 and 9 the knife cuts comprise segments defining mutually facing concave regions, one segment being shorter than the other, and terminating in a region enclosed by the longer segment and a line connecting its end points. Also, each longer segment is closer to the free edge portion of the top wall than is the shorter segment, and both knife cuts 140 and 240 have symmetry about a line extending at right angles to the said free edge portion.

While some preferred alternative embodiments of the invention have been disclosed, it will be appreciated that the invention is susceptible of such other modifications as are contemplated by the scope of the claims.

I claim:

1. A reclosable paperboard carton structure comprising:

an open-top body portion including upstanding front and rear walls and opposed end walls;

a cover including a top wall hinged along an edge portion thereof to said rear wall, and a depending front flap on the free edge portion of said top wall opposite the recited hinged edge portion; and means releasably adhering said flap to said front wall comprising adhesive on said front wall and said flap in predetermined areas thereof defined by a pattern of discontinuous first knife cuts provided in at least one of said front wall and said flap, whereby said flap is releasable to open said top wall by pulling said flap away from said front wall and peeling the surfaces of said areas of paperboard defined by said first knife cuts.

2. The carton structure of claim 1, wherein each said pattern of discontinuous first knife cuts is disposed along a horizonatlly extending line.

3. The carton structure of claim 1, including a substantially horizontal second knife cut in one of said front wall and said flap, in confronting, overlying registry with each said pattern of discontinuous first knife cuts.

4. The carton structure of claim 1, wherein each said pattern of first knife cuts comprises generally semicircular segments having their concave sides facing one another, said segments being of different lengths, the segment of lesser length terminating at points in a region within the segment of greater length.

5. The carton structure of claim 1, wherein each said pattern of first knife cuts comprises generally curvilinear segments having théir concave sides facing one another, said segments being of different lengths, the shorter of said segments terminating within the region enclosed by said segment of greater length and a line connecting the ends of the greater length segment.

6. The carton structure of claim 1, wherein each said pattern of first knife cuts comprises segments defining mutually facing concave regions, one segment being shorter than the other and terminating in a region enclosed by the longer segment and a line connecting the ends of the longer segment.

7. The carton structure of claim 1, wherein said discontinuous first knife cuts are generally semi-circular and said areas are generally circular.

8. The carton structure of claim 7, wherein said discontinuous semi-circular first knife cuts are symmetrically disposed above and below a generally horizontally extending main diameter of each said circular area.

9. The carton structure of claim 8, including a substantially horizontal second knife cut in one of said front wall and said flap, in confronting, overlying registry with a portion of each said semi-circular pattern of first knife cuts disposed above said main diameter.

10. The carton structure of claim 9, wherein said semi-circular patten of first knife cuts are provided in said front wall and said second knife cuts are in said flap.

11. The carton structure of claim 8, wherein each said pattern of discontinuous first knife cuts includes a substantially semi-circular lower knife cut segment having its diametric chord extending substantially parallel to and below said main diameter, an upper knife cut segment spaced slightly above said diameter, and a pair of end segments, each end segment extending downwardly at an angle from opposite ends of said upper segment and terminating substantially at a level below the ends of said semi-circular lower segment, each said pair of end segments being spaced from the ends of said semi-circular lower segments.

12. The carton structure of claim 11, wherein said first knife cuts are disposed in said front wall.

13. The carton structure of claim 11, including a substantially horizontal second knife cut in one of said front wall and said flap, in confronting overlying registry with each said upper knife cut segment.

14. The carton structure of claim 13, wherein said first knife cuts are disposed in said front wall, and said second knife cuts are disposed in said flap.

15. The carton structure of claim 7, 8, or 9, wherein each said pattern of discontinuous first knife cuts are disposed in said front wall.

16. The carton structure of claim 4, 5, or 6, wherein each said pattern of first knife cuts is divided into upper and lower segments by a line extending across at least one of said front wall and said flap.

17. The carton structure of claim 16, including a substantially horizontal second knife cut in one of said front wall and said flap, in confronting, substantially overlying registry with each said upper knife cut segment.

18. The carton structure of claim 17, wherein said first pattern of knife cuts comprising upper and lower segments are in said front wall, and said second knife cuts are in said flap.

* * * * *

UNITED STATES PATENT AND TRADEMARK OFFICE

CERTIFICATE OF CORRECTION

PATENT NO. : 4,436,206

DATED : March 13, 1984

INVENTOR(S) : MORRIS W. KUCHENBECKER

It is certified that error appears in the above—identified patent and that said Letters Patent is hereby corrected as shown below:

Claim 15 should read:

15. The carton structure of claim 7, 8, or [9] 2, wherein each said pattern of discontinuous first knife cuts are disposed in said front wall.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*